US006273630B1

(12) United States Patent
Sgro et al.

(10) Patent No.: US 6,273,630 B1
(45) Date of Patent: Aug. 14, 2001

(54) SHEET LIFTER

(75) Inventors: Sam Sgro, NewMarket (CA); Timothy Edward McKeown, Glen Ellyn; Scott Harold Wilson, Evanston, both of IL (US)

(73) Assignee: ACCO Brands Inc., Lincolnshire, IL (US)

( * ) Notice: Subject to any disclaimer, the term of this patent is extended or adjusted under 35 U.S.C. 154(b) by 0 days.

(21) Appl. No.: 09/441,193

(22) Filed: Nov. 16, 1999

(51) Int. Cl.[7] ..... B42F 13/00

(52) U.S. Cl. ..... 402/80 L; 402/80 P; 281/42

(58) Field of Search ..... 402/80 L, 80 R, 402/80 P, 79, 3; 281/42, 28, 45, 46, 49, 51; 116/239

(56) References Cited

U.S. PATENT DOCUMENTS

| | | | |
|---|---|---|---|
| 140,610 | 7/1873 | Buell et al. . | |
| 512,267 | 1/1894 | Austrian . | |
| 665,650 | 1/1901 | Clymer . | |
| 1,056,322 | 3/1913 | Carson . | |
| 1,741,066 * | 12/1929 | Morgan | 402/79 |
| 1,936,489 | 11/1933 | Thomson | 45/59 |
| 2,194,576 | 3/1940 | Truesdale | 116/119 |
| 2,424,541 | 7/1947 | Booth | 116/119 |
| 3,416,817 | 12/1968 | Gia-Quinto | 281/42 |
| 4,423,976 * | 1/1984 | Feldmahr et al. | 402/80 L |
| 4,437,685 | 3/1984 | Valencia | 281/42 |
| 5,033,899 | 7/1991 | Pitts et al. | 402/80 R |
| 5,713,682 | 2/1998 | Clark et al. | 402/7 |

FOREIGN PATENT DOCUMENTS

| | | |
|---|---|---|
| 1053277 | 2/1954 | (FR) . |
| 501153 | 2/1939 | (GB) . |

* cited by examiner

*Primary Examiner*—Willmon Fridie, Jr.
(74) *Attorney, Agent, or Firm*—Pennie & Edmonds LLP

(57) ABSTRACT

A sheet lifter for use with a ring-binder for storing loose-leaf pages having a substantially flat base portion with first and second lateral sides. The base portion further includes at least one aperture located between the first and second sides for receiving and mounting to the rings of the binder. An end portion is connected to the base portion and is configured to extend beyond the pages stored in the ring-binder when the sheet lifter is engaged by the rings of the binder. The two sides are connected to the end portion and are non-parallel with respect to each other.

20 Claims, 5 Drawing Sheets

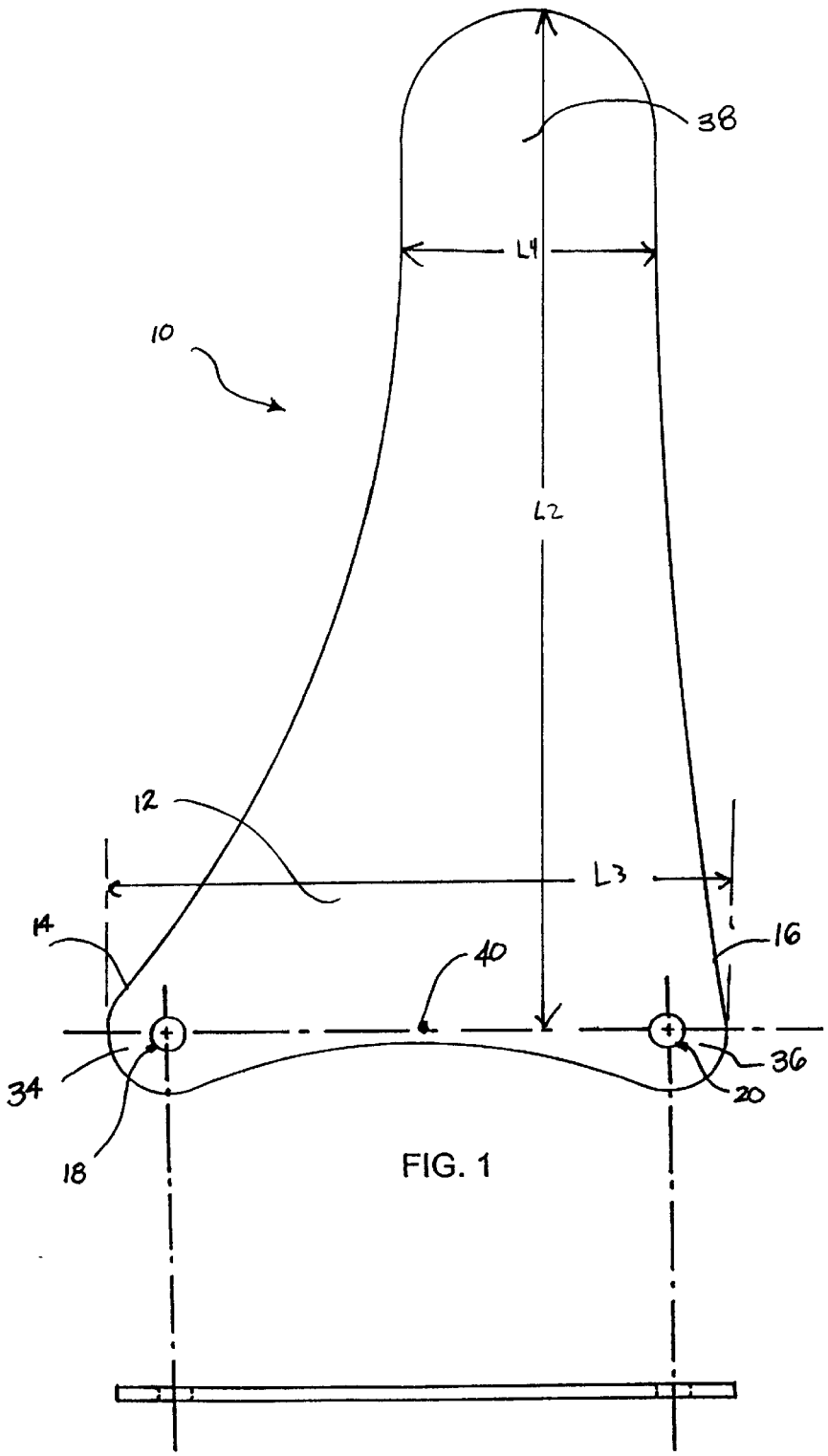
FIG. 1
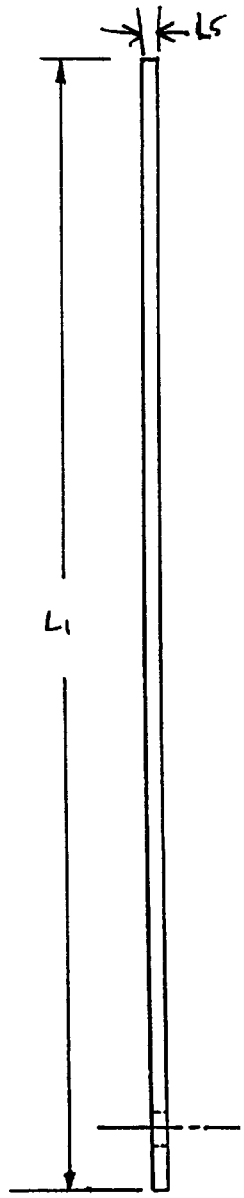
FIG. 2
FIG. 3

SHEET LIFTER

BACKGROUND OF THE INVENTION

Index tabs, dividers, page markers and holders have been designed for arranging and locating documents in three-ring binders or wirebound notebooks. Typically these index tabs or page markers extend beyond the pages contained in the binder to form an index display. The index display allows the user to exhibit information concerning the pages contained therein. For example, U.S. Pat. No. 5,033,899 to Pitts et al. discloses an index tab for use with loose-leaf binders comprising a base portion having a plurality of apertures engageable to the rings of a ring binder. An index portion protrudes beyond the tops of the pages. The index tab covers only the margin area of the pages to expose the majority area of the pages allowing users to view the contents of and for inscriptions on the pages.

Other tab dividers are used to separate and index different stacks of pages contained in a binder. Tab dividers have apertures at the base portion for receiving rings of a binder and have protruding tabs for affixing labels. These tab dividers generally have the same dimensions as the pages contained in the binder.

Existing sheet lifting devices are available for lifting and turning pages in a ring binder. These devices are adapted for insertion into a three-ring binder and are intended to facilitate guiding the sheets of pages in the binder over the rings of the binder when closing the covers. These devices function in cooperation with the covers of the binder to turn the pages over the rings of the binder when the user closes the binder. In order to better cooperate with the covers, these devices do not extend beyond the edge of the pages. For example, a Wilson Jones™ shift lifter is formed from a flat, triangular plastic sheet and has apertures for receiving the rings of a binder. As it does not extend beyond the edges of the pages contained in the binder, this configuration is not easily manipulable by hand as it is intended for the binder cover to actuate the page lifter in lifting and turning the pages in the binder during the closing of the binder.

U.S. Pat. No. 3,416,817 to Gia-Quinto discloses a combined page marker and holder made from a wire. Two legs of the wire engage rings of a binder. When attached to the binder, the end of the marker extends longitudinally beyond the pages of the binder.

SUMMARY OF THE INVENTION

The invention is directed to a sheet lifter that can be used with a ring-binder for lifting the pages over the rings. The sheet lifter preferably has a substantially flat base portion with first and second lateral sides disposed opposite from each other the base portion has at least one aperture, but preferably at least two, located between the first and second sides for receiving and mounting to the rings of the binder. The sheet lifter also has an end portion connected to the base portion and configured to extend longitudinally beyond the pages stored in the ring-binder when the sheet lifter is mounted to the rings of the binder. The two sides of the base portion are connected to the end portion and are substantially non-parallel with respect to each other.

This invention permits a user to tab and separate groups of pages in a binder and also to lift the pages therein by lifting the end portion. Also, most of the sheets remain visible and material is saved as the sheet lifter can cover substantially less than the whole page adjacent thereto.

DESCRIPTION OF THE DRAWINGS

FIG. 1 is a front elevational view of an embodiment of sheet lifter constructed according to the present invention;

FIG. 2 is a side view thereof;

FIG. 3 is a bottom view thereof;

DETAILED DESCRIPTION OF THE PREFERRED EMBODIMENTS

Figure 4:
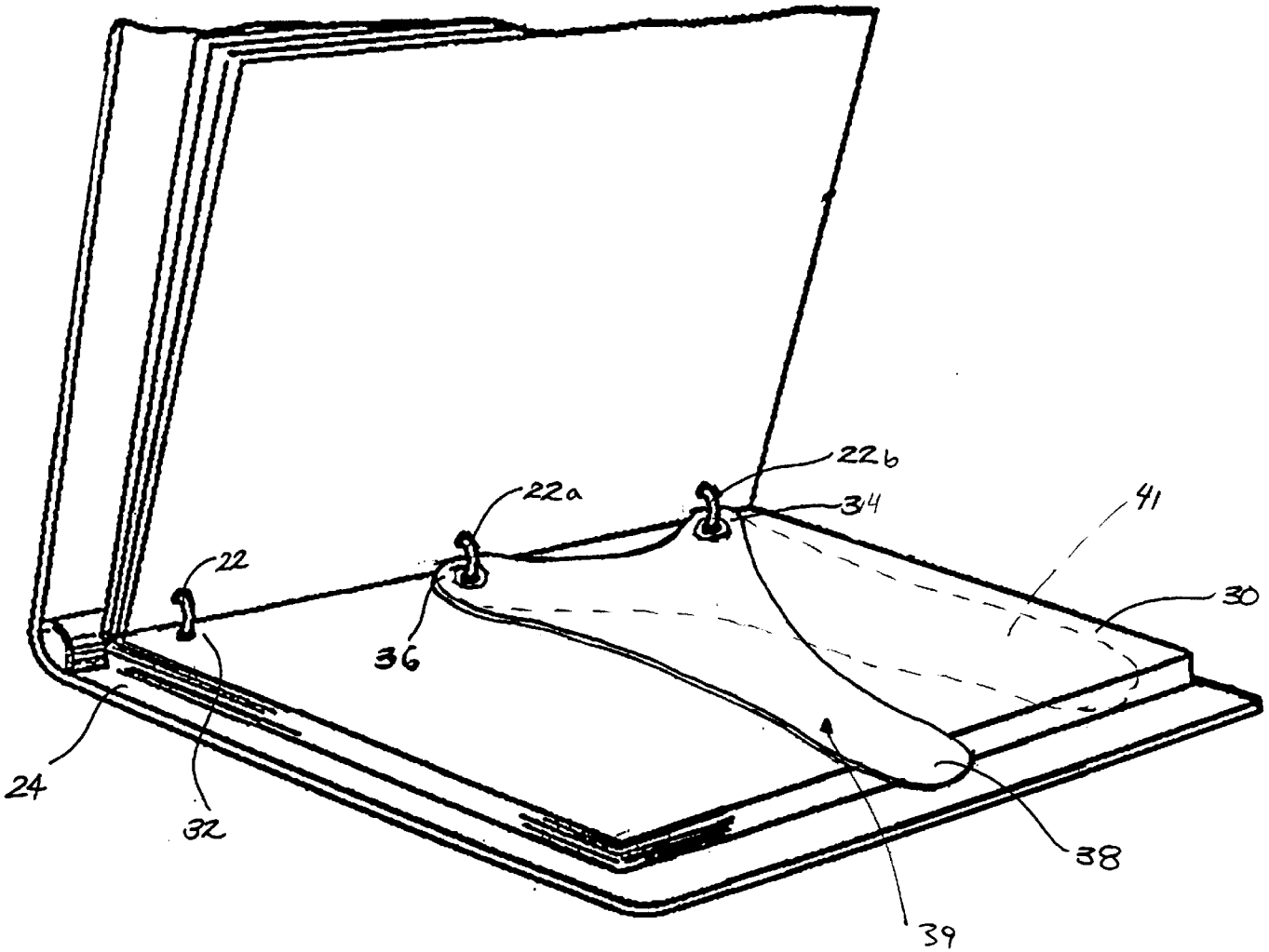
FIG. 4 is a perspective view of the sheet lifter of FIG. 1 shown in engagement with rings of a binder.
Figure 5:
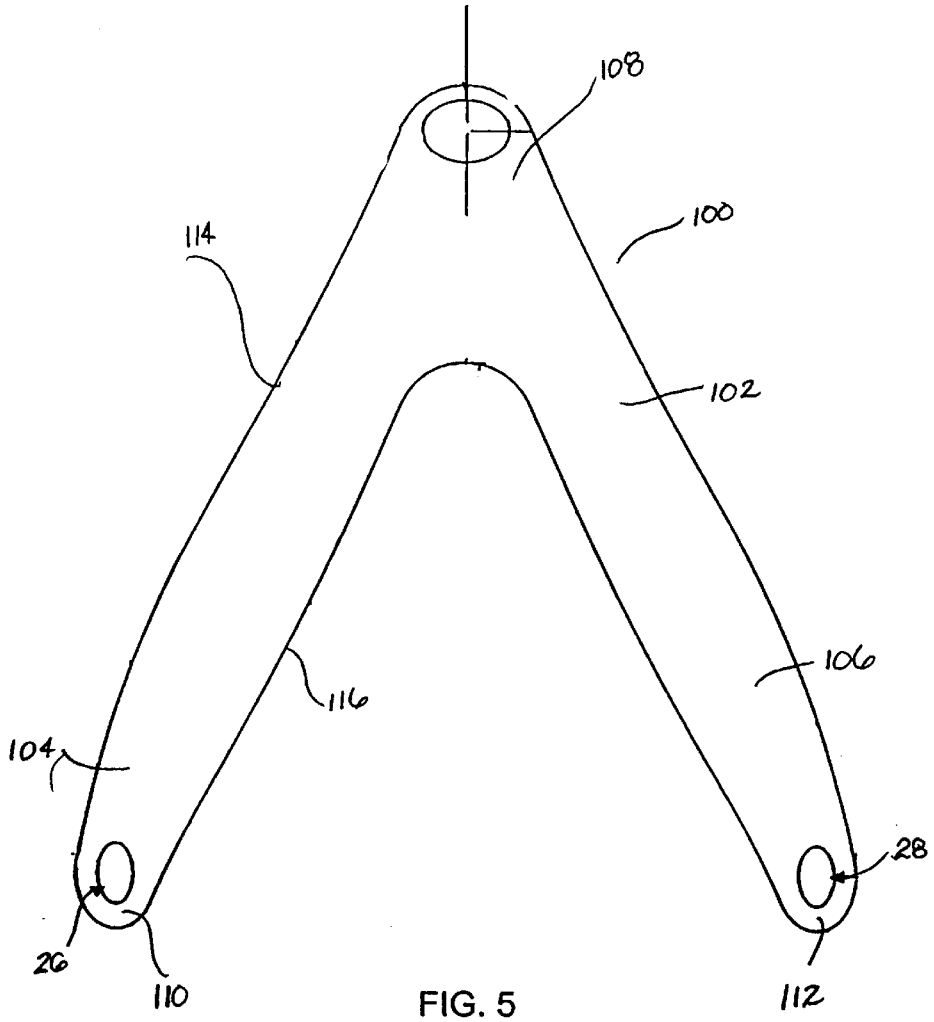
FIG. 5 is a front elevational view of another embodiment of the present invention.

Turning to FIG. 1–3, a preferred embodiment of a sheet lifter 10 has a substantially triangular shape with a base portion 12. The base portion 12 has a first lateral side 14, a second lateral side 16 disposed opposite from the first lateral side 14. The two sides 14 and 16 are shown as non-parallel with respect to each other. The sheet lifter 10 is constructed from a substantially flat material. Most preferably, the sheet lifter 10 is constructed from a resilient and flat material. Ring apertures 18 and 20 are located proximate to the first and second sides 14 and 16 and are configured for receiving the rings 22 of a binder 24, as shown in FIG. 4. Preferably, these apertures 18 and 20 are substantially circular in shape and are dimensioned to receive binder rings 22 of the binder 24 for mounting the sheet lifter 10 thereto. The ring apertures may also have an elliptical shape 26, as shown in FIG. 5, to allow greater tolerance in moving the sheet lifter 10 against the rings 22 of the binder 24 when it is thus engaged. Moreover, since the size of the rings 22 in a loose-leaf binder 24 is typically provided to accommodate the capacity of the intended binder, these apertures 18, 20, 26 and 28 may vary in size according to the size of the binder 24. Additionally, the apertures 18, 20, 26 and 28 may be in the shape of hooks, open at a lateral edge.

In managing a stack of pages 30 in the loose-leaf binder 24, the hole-punched portion 32 of the margin area of the pages 30 is typically most vulnerable to tears when the pages 24 are manipulated in the binder 24. Accordingly, the sheet lifter 10 is preferably provided with first and second and supports 34 and 36 on the base portion 12 and enclosing the apertures 18 and 20 with sufficient width so that the area on the pages surrounding the punched holes 32 is supported by the supports 34 and 36. Preferably the supports are at least about ⅛ inches wide. The first and second supports 34 and 36 preferably provide sufficient support to the areas surrounding the punched hole 32 to protect the pages from being torn from the binder 24 when they are turned.

The sheet lifter 10 has an end portion 38 that is connected to the base portion 12 and is configured to extend longitudinally beyond the pages 30 stored in the binder 24 when the sheet lifter 10 is engaged by the rings 22 of the binder 24, as shown in FIG. 2. The end portion 38 provides a grapable surface for the user to facilitate the lifting and turning of the sheet lifter 10 over the rings 22 of the binder 24. In this embodiment, the end portion 38 is out of alignment with a center point 40 defined between the first and second supports and ring apertures 18, 20, best shown in FIG. 1. Although offset, the end portion is preferably not located laterally outside the sides 14, 16 or the apertures 18, 20, to facilitate lifting of the sheets by pulling on the end portion. This out of alignment configuration allows multiple sheet lifters 10 to be used in combination for dividing the stack of sheets 30 contained in the three-ring binder 24.

For example, by engaging the first and second apertures 18 and 20 of the sheet divider 10 respectively to the top and center rings 22*b*, 22*a* of the binder, the sheet lifter is in a first position in a first orientation 39, in which the end portion 38 is shifted in alignment with respect to the center point 40 toward support 34 and extends beyond the pages 30 at a first longitudinal location. A second sheet lifter 10 may be engaged to the center and bottom rings of the binder 22, allowing the end portion 38 to extend beyond the pages 30 at a second longitudinal location with respect to the pages 30.

Additionally, a third sheet lifter 10 may be flipped over to a second orientation 41 where the apertures 20 and 18 are respectively engaged with the top and center rings 22*a*, 22*b* of the binder 24 such that the end portion 38 is shifted in alignment with respect to the center point 40 toward the top of the binder instead of the bottom, as shown in orientation 39, extending beyond the pages at a third longitudinal location. Similarly, a fourth longitudinal location can obtained by engaging the apertures 18 and 20 of the sheet lifter 10 in the second orientation but with the center and bottom rings 22 of the binder 24. In this fashion, multiple sheet lifters 10 may be used in combination, with each corresponding end portion 38 easily distinguishable and accessible independently from the others.

The user may also append a label onto the end portion 38 or may inscribe thereon, allowing indexing or sectioning of the pages 30 contained in the binder 24. This embodiment provides various tab locations using a single configuration of sheet lifter 10.

The sheet lifter 10 is preferably of a unitary construction from a durable and flexible material, such as paper cardboard, stiff board, wood, or plastic and semi-rigid materials are preferred although soft materials like paper or rigid materials can alternatively be employed. The sheet lifter 10 may be opaque, transparent or semi-transparent. Additionally, the sheet lifter 10 may be of laminated construction with plies and layers of material. The material is preferably resilient and has sufficient strength and surface area to support and lift the pages 30 held in the binder 24 over the rings 22 of the binder 24 without substantial strain in the end portion 38 and the apertures 18 and 20 disposed on the first and second sides 14 and 16.

The sheet lifter 10 can be configured for use with a variety of standard sheet and binder sizes as well as non-standard articles. Standard size sheets include, for example, U.S. letter size, 8½ inches by 11 inches; U.S. legal size, 8½ inches by 14 inches; and Metric size A4, which measures 8.27 inches by 11.69 inches. An exemplary sheet lifter configured for a three-ring binder for storing U.S. letter size, 8½ inches by 11 inches, preferably a length, L1, which measures between 8¾ to 11 inches, more preferably about 9½ M inches. The aperture 18 and 20 preferably have a radius of at least 0.2 inches.

The sheet lifter preferably has a length L2 from the longitudinal center of the apertures to the lateral tip of the end portion that is preferably 1.5 to 2 times greater than the lateral length L3 from one lateral side 14 to the other 16 or otherwise between the aperture centers (or distance between the rings of the binder with which the sheet lifter is to be used), and more preferably 1.7 to 1.9 times greater, and most preferably about 1.8 times greater. Also, the sheet lifter is preferably flat and significantly wider (such as at the narrow part of the base at L4) than thick L5, preferably at least by a factor of about 5 but preferably by more than a factor of about 20.

Figure 6:
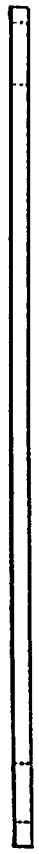
FIG. 6 is a side view thereof.
Figure 7:
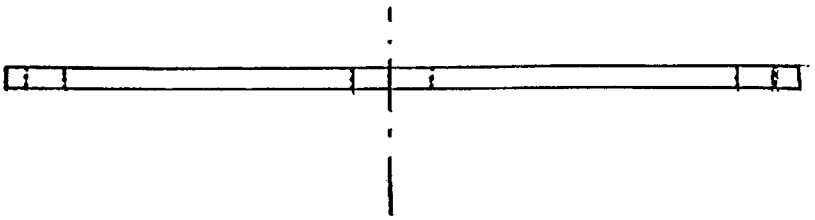
FIG. 7 is a bottom view thereof.

Another embodiment according to the present invention is shown in FIGS. 5–7, wherein the sheet lifter 100 has a substantially inverted V-shape base member 102 with two legs 104 and 106 meeting at an end portion or end portion 108. The two legs 104 and 106 extend from the end portion 108 to first and second supports 110 and 112. Similar to the first embodiment, the sheet lifter 100 is preferably made from a flexible flat sheet like material as shown in FIGS. 6 and 7 in which the thickness of the material is exaggerated for clarity. The two legs 104 and 106 form a convex outer side 114 and a concave inner side 116, defining the contours of the sheet lifter 100 and connecting the first and second legs 104 and 106 to the end portion 108. The contour of the convex outer side 114 substantially corresponds to the contour of the concave inner side 116. In addition, the convex and concave sides 114 and 116 of the sheet lifter 100 are preferably gently curved from the end portion 108 to the first and second supports 110 and 112, forming rounded edges 116 at the first and second supports 110 and 112 and the end portion 108. Preferably the apex 108 and the two supports 110 and 112 are formed with rounded edges 116 to prevent the edges 116 from catching on other documents or pages in the binder. The end portion 108 also preferably has a substantially oval shaped gripping aperture dimensioned large enough for a user to place a finger to facilitate lifting sheet lifter 100.

Figure 8:
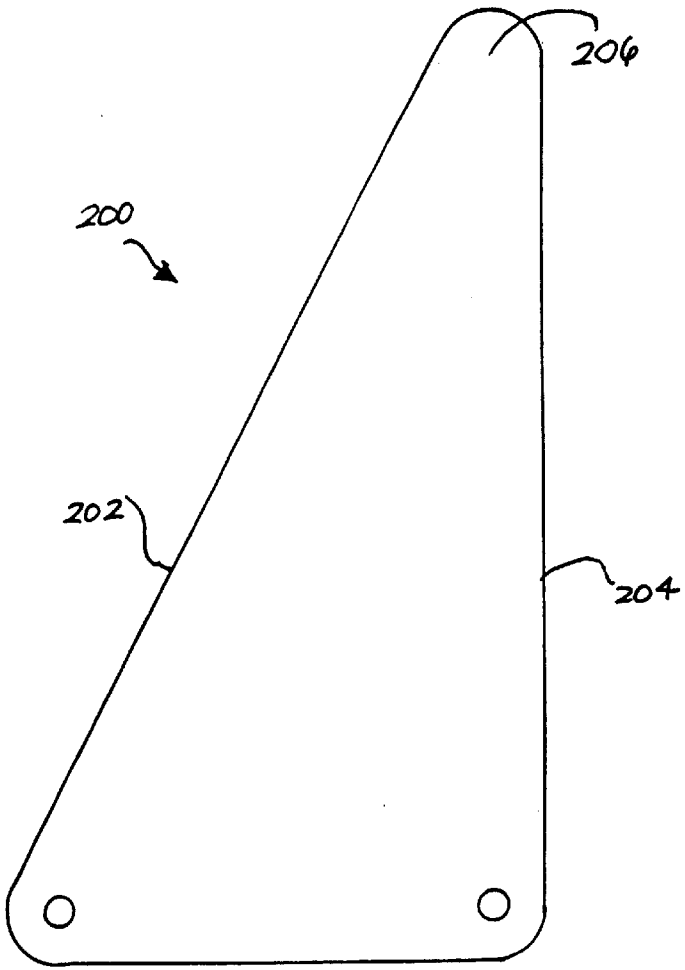
FIG. 8 is a front elevational view of a third embodiment of the present invention.

The legs 104 and 106 of the sheet lifter 100 have a sufficient width to provide additional support in lifting the pages of the binder. In this embodiment, the widest longitudinal width of the sheet lifter 100 preferably coincides with the mid-section of the pages 30 contained in the binder 24 to increase support for this area of the stack of bound paper The sheet lifter according to the present invention may have various outer configurations as shown in FIG. 8. FIG. 8 shows a sheet lifter 200 having a triangular shape, which is preferably approximately a right angle triangle and first and second sides 202 and 204. An end portion 206 is shown as displaced towards the second side 204.

Figure 9:
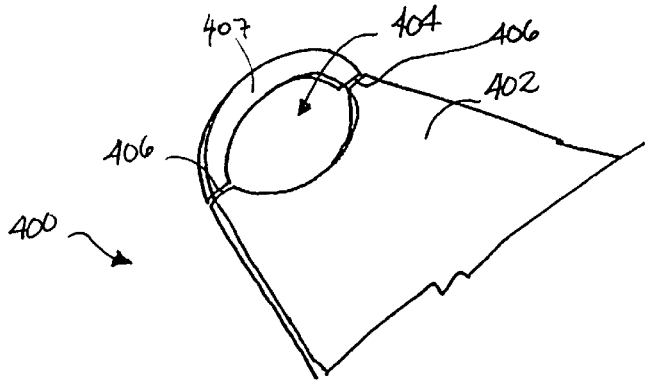
FIG. 9 is a partial perspective view of an embodiment of the end portion of the present invention.

According to the present invention, gripping apertures, which are preferably cutouts, but may alternatively be made of other methods such as in a molding step, may be located in the end portion to facilitate the gripping thereof and turning the sheets contained in the binder. Referring now to FIG. 9, an end portion 400 is shown having a finger hole 404 gripping aperture in the form sized to receive a finger to assist with lifting and turning the sheet lifter and the pages 30 contained in the binder 24 over the rings 22 of the binder 24. In addition, a hinge, which in this embodiment includes aligned scorelines 406 on each side of the finger hole 404 dissect the finger hole 404 permitting pivotal movement of the grasping portion 407 with respect to the rest of the end portion 400. Such movement facilitates grasping or lifting of the sheet lifter 400 with a finger by elevating the grasping portion 407 from a convex of the binder, and angling it more towards the direction of lifting of the end portion 400.

Figure 10:
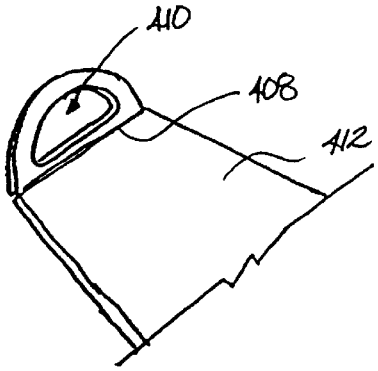
FIG. 10 is a partial perspective view of another embodiment of the end portion of the present invention.
Figure 11:
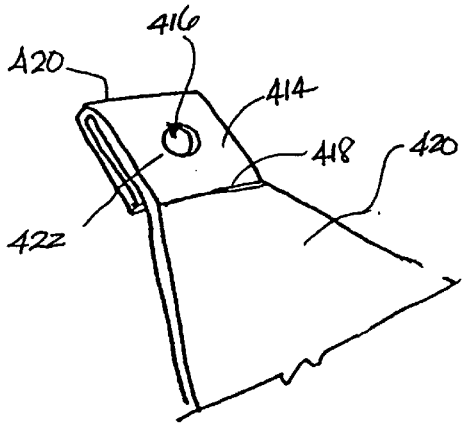
FIG. 11 is a partial perspective view of another embodiment of the end portion of the present invention.
Figure 12:
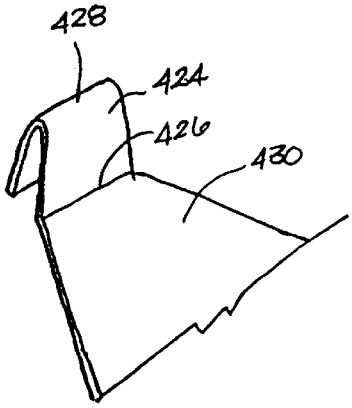
FIG. 12 is a partial perspective view of another embodiment of the end portion of the present invention.
Figure 13:
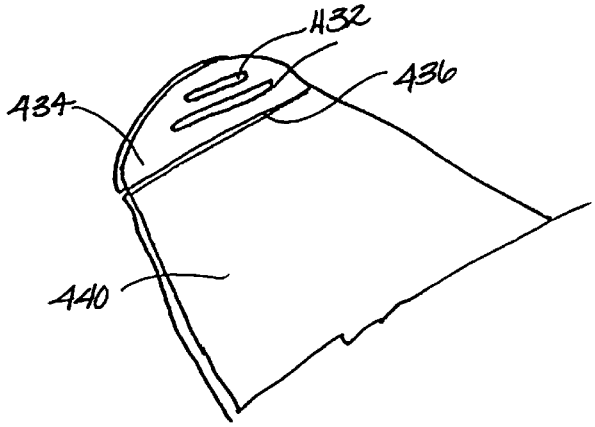
FIG. 13 is a partial perspective view of another embodiment of the present invention.

Alternatively, a score line 408 may be located away from a cut-out or finger hole 410 as shown in FIG. 10. In this embodiment, the finger hole 410 is in a substantially flat portion of an end portion 412. FIG. 11 shows an end portion 414 having a cut-out 416 smaller than the previous embodiments. The end portion 414 further includes first and second score lines 418 and 420, such that the first score line 418 allows pivotable movement of the end portion 414 with respect to a base portion 421 of the sheet lifter 400, and the second score line 420 allows the end portion 414 to be folded over to form a tab 422 of greater thickness than the reminder of the sheet lifter. FIG. 12 shows an end portion 424 having first and second score lines 426 and 428 for pivotable movement of the end portion 424 with respect to a base portion 430. Additionally, ribs or embossments 432 may be disposed in an end portion 434 of the sheet lifter as shown in FIG. 13. The end portion 434 includes a score line 436, allowing pivotal movement of the end portion with respect to a base portion 440. The embossments 432 facilitate accessing, holding and gripping the end portions 434, allowing greater ease in using the sheet lifter 400.

One of ordinary skill in the art can envision numerous variations and modifications. All of these modifications are contemplated by the true spirit and scope of the following claims.

What is claimed is:

1. A sheet lifter for use with a ring-binder storing loose-leaf pages, comprising:

(a) a base portion of sheet material and having:

(i) a first lateral side, (ii) a second lateral side disposed opposite from the first lateral side, and (iii) at least one ring aperture located between the first and second sides for receiving and mounting to the rings of the binder;

(b) an end portion connected to the base portion and configured to extend beyond the pages stored in the ring-binder in a direction opposite from the ring aperture when the sheet lifter is mounted to the rings of the binder; and (c) a hinge pivotably connecting the end portion to the base portion;

wherein the two sides are connected to the end portion and are substantially non-parallel with respect to each other.

2. The sheet lifter of claim 1, wherein the at least one ring aperture comprises a first ring aperture located on the base portion proximate to the first side and a second ring aperture located on the base portion proximate to the second side for engaging the rings of the binder.

3. The sheet lifter of claim 2, wherein the base portion encloses both ring apertures.

4. The sheet lifter of claim 2, wherein the end portion is substantially laterally aligned with respect to the first and second ring apertures.

5. The sheet lifter of claim 2, wherein the end portion is offset laterally with respect to first and second ring apertures.

6. The sheet lifter of claim 1, wherein the first side has a first length and the second side has a second length substantially equal to the first length.

7. The sheet lifter of claim 1, wherein the first side has a first length and the second side has a second length substantially greater than the first length.

8. The sheet lifter of claim 1, wherein the end portion comprises a gripping aperture configured and dimensioned to receive a finger sufficiently to assist with lifting and turning the sheet lifter and any adjacent pages.

9. The sheet lifter of claim 8, wherein the hinge comprises a score line.

10. The sheet lifter of claim 9, further comprising another hinge located in the end portion and configured for bending the end portion to form a tab of increased thickness.

11. The sheet lifter of claim 9, further comprising at least one embossment disposed on the end portion.

12. A sheet lifter for use with a ring-binder for storing loose-leaf pages, comprising:

(a) a first leg of a sheet material;

(b) a second leg of a sheet material and disposed opposite and spaced from the first leg;

(c) at least one ring aperture located on each of the legs for receiving and mounting to the rings of the binder; and (d) an end portion connected to the legs and configured to extend beyond the pages stored in the ring-binder when the sheet lifter is engaged by the rings of the binder.

13. The sheet lifter of claim 12, wherein:

(a) the at least one ring aperture comprises first and second ring apertures; and (b) the rings of the binder comprises a first and second ring;

wherein the sheet lifter is in a first orientation where the first and second ring apertures are respectively mounted to the first and second rings and the sheet lifter is turned over to a second orientation where the second and first ring aperture are respectively mounted to the first and second ring.

14. The sheet lifter of claim 1, wherein the base portion comprises first and second legs of sheet material defining the first and second lateral sides, the first and second legs being spaced from each other.

15. The sheet lifter of claim 12, wherein the two legs define a center point and the end portion is laterally out of alignment with respect to the center point.

16. The sheet lifter of claim 12, wherein the end portion is of a sheet material.

17. The sheet lifter of claim 12, wherein:

the end portion and first and second legs define outer and inner side contours; and wherein the shape of the outer side contour substantially corresponds with the shape of the inner side contour.

18. The sheet lifter of claim 12, wherein the sheet lifter has a sheet lifter height from the ring aperture through the end portion and the legs are spaced laterally from each other by a leg space that extends longitudinally along most of the sheet lifter height.

19. A sheet lifter for use with a ring-binder storing loose-leaf pages, comprising:

a substantially flat base portion having:

a first lateral side, a second lateral side disposed opposite from the first lateral side, and at least one ring aperture located between the first and second sides for receiving and mounting to the rings of the binder; and an end portion connected to the base portion and comprising a gripping aperture configured to extend beyond the pages stored in the ring-binder in a direction opposite from the ring aperture when the sheet lifter is mounted to the rings of the binder and configured and dimensioned to receive a finger to sufficiently assist with lifting and turning the sheet lifter and any adjacent pages;

wherein the two sides are connected to the end portion and are substantially non-parallel with respect to each other.

20. The sheet lifter of claim 19, wherein the gripping aperture is generally oval.

* * * * *